US011333324B1

(12) United States Patent
Gu et al.

(10) Patent No.: US 11,333,324 B1
(45) Date of Patent: May 17, 2022

(54) LAMP AND OPTICAL LENS THEREOF

(71) Applicant: Aputure Imaging Industries Co., Ltd., Shenzhen (CN)

(72) Inventors: Haijun Gu, Shenzhen (CN); Xiangjun Zhou, Shenzhen (CN)

(73) Assignee: Aputure Imaging Industries Co., Shenzhen (CN)

( * ) Notice: Subject to any disclaimer, the term of this patent is extended or adjusted under 35 U.S.C. 154(b) by 0 days.

(21) Appl. No.: 17/127,040

(22) Filed: Dec. 18, 2020

(30) Foreign Application Priority Data

Nov. 6, 2020 (CN) ..... 202022545104.4

(51) Int. Cl.

| | |
|---|---|
| ***F21V 14/06*** | (2006.01) |
| ***F21V 5/00*** | (2018.01) |
| ***F21V 33/00*** | (2006.01) |
| ***F21V 21/22*** | (2006.01) |
| ***F21V 17/02*** | (2006.01) |

(52) U.S. Cl.
CPC ..... *F21V 14/06* (2013.01); *F21V 5/008* (2013.01); *F21V 17/02* (2013.01); *F21V 21/22* (2013.01); *F21V 33/0052* (2013.01)

(58) Field of Classification Search
CPC ..... F21V 14/06; F21V 14/065; F21V 14/085; F21V 14/006; F21V 14/08; F21V 5/008; F21V 33/0052; F21V 17/02; F21V 17/104; F21V 17/18; F21V 19/02; F21V 21/22; F21V 21/34; F21V 15/012; F21V 13/12; F21L 4/04; F21L 4/045; F21L 15/02; F21L 15/08; G03B 21/142; G03B 21/145; G03B 21/20; G03B 21/12; F21S 10/007
See application file for complete search history.

(56) References Cited

U.S. PATENT DOCUMENTS

| | | | | |
|---|---|---|---|---|
| 3,020,390 | A * | 2/1962 | Lusk | F21V 9/40 362/268 |
| 5,295,056 | A * | 3/1994 | Peck | F21V 17/02 362/267 |
| 5,345,371 | A * | 9/1994 | Cunningham | F21V 11/18 362/297 |
| 5,404,283 | A * | 4/1995 | Yantz | F21V 11/18 362/267 |
| 9,395,066 | B2 * | 7/2016 | Nemeyer | F21L 4/005 |
| 2003/0076682 | A1 * | 4/2003 | Tanaka | F21V 29/83 362/280 |
| 2004/0017685 | A1 * | 1/2004 | Dedoro | F21V 5/045 362/268 |

(Continued)

*Primary Examiner* — Jong-Suk (James) Lee
*Assistant Examiner* — James M Endo
(74) *Attorney, Agent, or Firm* — Brooks Kushman P.C.

(57) ABSTRACT

The present application relates to the technical field of films and television lighting, and provides a lamp and an optical lens thereof, the lamp includes: a lamp body, a first housing and a second housing, the first housing is provided with slots, the second housing is movably sleeved inside the first housing, and an outer wall of the second housing is provided with a protruding member extending through the slots, the protruding member further simultaneously moves relative to the second housing while moves in the slot, to adjust a distance between the second housing and the lamp body. When the protruding member moves in the slot on the first housing, a part of the protruding member can also move relative to the second housing at the same time.

12 Claims, 4 Drawing Sheets

(56) References Cited

U.S. PATENT DOCUMENTS

| | | | | |
|---|---|---|---|---|
| 2005/0254233 | A1* | 11/2005 | Alessio | F21V 14/06 362/169 |
| 2005/0286250 | A1* | 12/2005 | Tanaka | G02B 7/10 362/319 |
| 2007/0297070 | A1* | 12/2007 | Shimizu | G02B 7/10 359/701 |
| 2008/0137345 | A1* | 6/2008 | Wimberly | F21V 7/09 362/299 |
| 2009/0303723 | A1* | 12/2009 | Cavenati | F21V 14/06 362/268 |
| 2011/0164416 | A1* | 7/2011 | Pujol | F21V 7/28 362/235 |
| 2012/0140463 | A1* | 6/2012 | Kinzer | F21V 5/007 362/231 |
| 2013/0058094 | A1* | 3/2013 | Jurik | F21V 11/183 362/277 |
| 2013/0069549 | A1* | 3/2013 | Kreitzer | F21V 5/04 315/200 R |
| 2014/0333907 | A1* | 11/2014 | Takehana | G02B 27/141 353/101 |
| 2015/0241031 | A1* | 8/2015 | Cheng | F21L 4/005 362/187 |
| 2015/0252983 | A1* | 9/2015 | Lee | F21V 14/065 362/109 |
| 2017/0307966 | A1* | 10/2017 | Tanaka | G02B 7/09 |
| 2019/0235204 | A1* | 8/2019 | Ito | G02B 7/023 |

* cited by examiner

LAMP AND OPTICAL LENS THEREOF

CROSS-REFERENCE TO RELATED APPLICATION

The present application claims the priority of the Chinese patent application, with application No. 202022545104.4, filed on Nov. 6, 2020. The content of which is incorporated herein by reference.

TECHNICAL FIELD

The present disclosure relates to the technical field of films and television lighting, and more particularly to a lamp and an optical lens thereof.

BACKGROUND

Films and television lighting helps to express the content of the program, reflect the creative intentions of the author, highlight the artistic atmosphere, and enable the audience and the camera to get the correct color perception and exposure. At present, the method of focusing on the light of film and television lamps is usually to move one or two lenses to change the focus, adjust the spot and confine the light, for example, use a three-piece threaded set or guiding groove to move the lens, and during the movement of the lens, sliding friction occurs between the moved lens and the guiding groove or other fixed parts, which is easy to cause wear to the components, easy to be jammed, and poor adjustment accuracy, etc. after long-term use, and the use experience, adjustment accuracy and imaging quality of the lamp are affected.

SUMMARY

An object of the present application is to provide a lamp and an optical lens thereof, to improve the structure of the lamp, which is able to reduce the wear to the components, improve the use experience, adjustment accuracy and imaging quality of the lamp.

In order to achieve above object, the present application adopts the technical solution is:

A lamp, including: a lamp body; and the lamp further includes:

a first housing, connected to the lamp body, and an outer wall of the first housing is provided with slots; and a second housing, movably sleeved inside the first housing; an outer wall of the second housing is provided with a protruding member extending through the slots; and the protruding member further simultaneously moves relative to the second housing while moves in the slot, to adjust a distance between the second housing and the lamp body.

In another embodiment of the present application, the protruding member includes a driving lever and a driving lever ring, the driving lever is fixedly connected to the outer wall of the second housing, and the driving lever ring is movably sleeved onto the driving lever.

In another embodiment of the present application, the second housing is provided therein with a lens group configured for receiving light emitted from the lamp body, and the lens group is synchronously moved as moving of the second housing.

In another embodiment of the present application, the first housing is sleeved with an adjusting ring, and an inner wall of the adjusting ring is provided with a plurality of notches extending along an axial direction of the first housing and respectively corresponding to the slots; a distal end of the protruding member of the second housing passes through the corresponding slots and extends into the corresponding notch, and the adjusting ring is configured to rotate along a circumferential direction of the first housing to drive the protruding member to move along an inner wall of the slot and/or an inner wall of the notch.

In another embodiment of the present application, the first housing is movably sleeved with two second housings, the second housing close to the lamp body is provided with a first lens group, and the second housing away from the lamp body is provided with a second lens group, and the first lens group and the second lens group can be approached or moved away from each other.

In another embodiment of the present application, the first housing is provided with a first end portion, a middle portion and a second end portion connected in sequence, and the outer wall of the first housing is provided the two sets of slots spaced apart from each other; the protruding member of the second housing provided with the first lens group passes through the slot of the two sets of the slots, and the slot extends from the middle portion of the first housing to the first end portion of the first housing along an axial direction of the first housing; the protruding member of the second housing provided with the second lens group passes through the slot of the two sets of the slots, and the slot extends from the middle portion of the first housing to the second end portion of the first housing firstly and then to the first end portion of the first housing along an axial direction of the first housing, and the two set of the slots are extended from the middle portion of the first housing to a same direction along a circumferential direction of the first housing.

In another embodiment of the present application, the first lens group is sequentially provided with a first convex lens, a first concave lens and a second convex lens in a light propagation direction; the second lens group is sequentially provided with a second concave lens and a third concave lens in a light propagation direction.

In another embodiment of the present application, the slots include three arc-shaped slots arranged at intervals in a circumferential direction.

In another embodiment of the present application, the lamp further includes a cap and a fourth convex lens, the cap is arranged on an end of the first housing away from the lamp body, and the fourth convex lens is fixedly arranged between the cap and the first housing.

In another embodiment of the present application, the first housing is provided with a predetermined number of first positioning holes on a side close to the cap, and the cap is provided with second positioning holes corresponding to the first positioning holes on a side close to the first housing, each first positioning hole and its corresponding second positioning hole are penetrated by a fixing member for fixedly connecting the cap and the first housing.

In another embodiment of the present application, the lamp further includes an adapter cylinder and a third convex lens, the adapter cylinder is fixedly arranged at an end of the first housing close to the lamp body, the third convex lens is fixedly arranged at an end of the adapter cylinder away from the first housing.

In another embodiment of the present application, the lamp further includes a front-end light control cylinder assembly, two ends of the f front-end light control cylinder assembly are respectively connected to the adapter cylinder and the lamp body, and the front-end light control cylinder assembly is able to extend and contract along an axial direction of an optical axis to adjust a distance between the adapter cylinder, the second housing and the first housing that are as a whole and the lamp body.

In another embodiment of the present application, radius of the adapter cylinder gradually decreases from a direction of the adapter cylinder to the lamp body, the front-end light control cylinder assembly includes a telescopic cylinder, a support cylinder and a focusing knob; the telescopic cylinder is fixedly connected to the adapter cylinder, and a wall of the telescopic cylinder is provided with a guiding groove and a positioning groove extended along an axial direction of the telescopic cylinder; one end of the support cylinder extends into the telescopic cylinder and located between the adapter cylinder and the telescopic cylinder, the other end thereof can be provided with one or more of an optical sectioning sheet, a diaphragm and a pattern sheet, and the support cylinder is fixedly connected with a U-shaped bracket at an outer wall thereof and provided with a focus positioning hole corresponding to a position of the guiding groove and a positioning protrusion corresponding to a position of the positioning groove; the focusing knob passes through the guiding groove and is matched with the focus positioning hole.

The present application further provides an optical lens for adjusting an imaging of a lamp body, including:

a first housing, connected to the lamp body, and an outer wall of the first housing being provided with a slot;

a second housing, movably sleeved inside the first housing;

wherein an outer wall of the second housing is provided with a protruding member, the protruding member passes through the slot, wherein the protruding member further simultaneously moves relative to the second housing while moves in the slot, to adjust a distance between the second housing and the lamp body; and a lens group, fixedly arranged in the second housing, wherein light emitted by the lamp body enters from one end of the first housing and is refracted by the lens group to be passed out from the other end of the first housing, and the lens group is synchronously moved with moving of the second housing.

The present application further provides an optical lens for adjusting an imaging of a lamp body, including:

a first housing, connected to the lamp body, and an outer wall of the first housing being provided with two sets of slots;

two second housings, movably sleeved inside the first housing; wherein an outer wall of the second housing is provided with a protruding member, the protruding member of one of the two second housings passes through the slot of the two sets of slots, and the other protruding member of one of the two second housings passes through the slot of the two sets of slots, wherein the protruding members further simultaneously moves relative to the second housing while moves in the corresponding slots;

a first lens group, arranged in the second housing close to the lamp body;

a second lens group, arranged in a second housing away from the lamp body, light emitted by the lamp body enters from one end of the first housing and is refracted by the first lens group and the second lens group in sequence to be passed out from the other end of the first housing, and an adjusting ring, rotatably sleeved on an outer wall of the first housing relative to the first housing, and the adjusting ring is provided therein with a plurality of notches configured for matching with the two sets of slots, and the protruding members of the second housing pass through the corresponding slots and extend to the corresponding notches, to drive the first lens group and the second lens group to approach or move away from each other.

The beneficial effects of the present application: the lamp and the optical lens thereof provided by the present application include a lamp body, a first housing and a second housing, the first housing is provided with slots, and the second housing is movably sleeved inside the first housing, the outer wall of the second housing is provided with a protruding member that passes through the slot, and the protruding member also moves relative to the second housing when moving in the slot, to adjust the distance between the second housing and the lamp body. When the protruding member moves in the slot on the first housing, a part of the protruding member can also move relative to the second housing at the same time, such that the sliding friction between the protruding member and the second housing can be adjusted to rolling friction, which reduces the friction force received by the protruding member and reduces the wear on the components, so that the second housing slides smoothly in the first housing. Corresponding after the lens group is arranged in each of the second housing of the lamp, the focusing or other adjustment operations of the optical lens are smoother and more precise, which can improve the use experience and imaging quality of the lamp, and improve the adjustment accuracy of the lamp.

BRIEF DESCRIPTION OF THE DRAWINGS

In order to explain the embodiments of the present application more clearly, a brief introduction regarding the accompanying drawings that need to be used for describing the embodiments of the present application or the prior art is given below; it is obvious that the accompanying drawings described as follows are only some embodiments of the present application, for those skilled in the art, other drawings can also be obtained according to the current drawings on the premise of paying no creative labor.

Among then, like elements are numbered alike as following.

Figure 1:
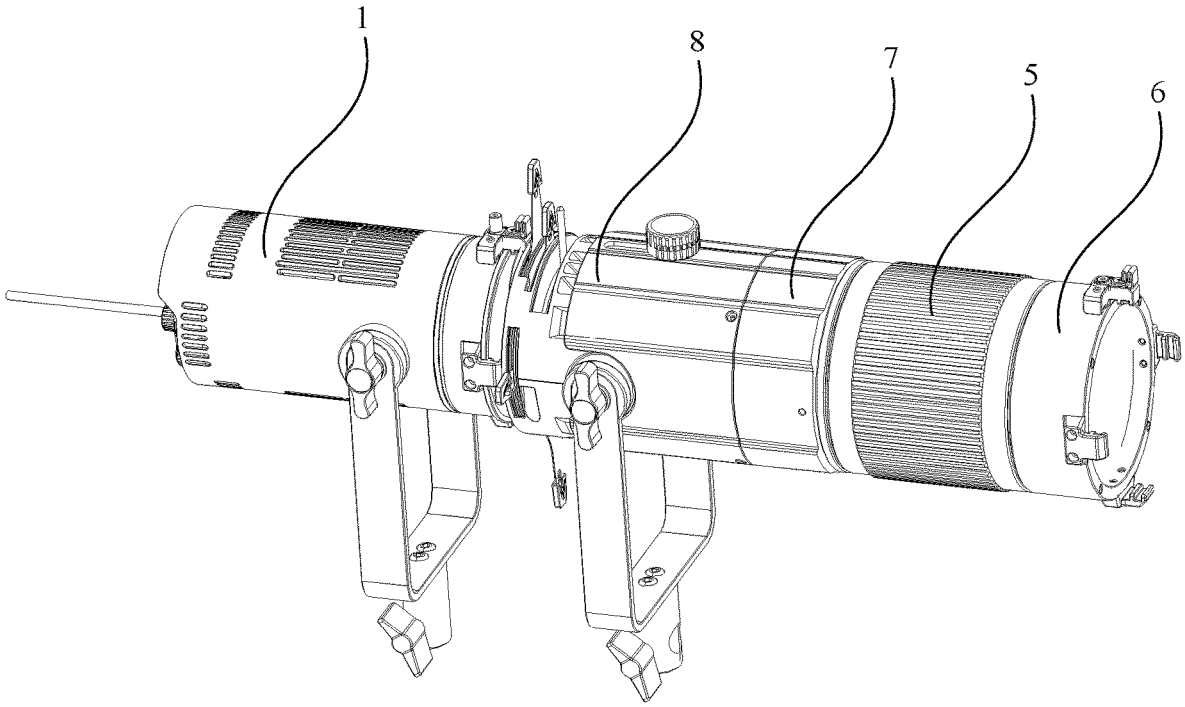
FIG. 1 is a structural view of a lamp and an optical lens thereof provided by an embodiment of the present application.

1—lamp body; 2—first housing; 21, 22—slot; 23—first end portion; 24—middle portion; 25—second end portion; 26—first positioning hole; 3—second housing; 31—protruding member; 311—driving lever; 312—driving lever ring; 41—first lens group; 411—first convex lens; 412—first concave lens; 413—second convex lens; 42—second lens group; 421—second concave lens; 422—third concave lens; 5—adjusting ring; 51—notch; 6—cap; 61—fourth convex lens; 7—adapter cylinder; 71—third convex lens; 8—front-end light control cylinder assembly; 81—telescopic cylinder; 811—guiding groove; 812—positioning groove; 813—U-shaped groove; 82—support cylinder; 821—focus positioning hole; 822—protrusion; 83—focusing knob; 84—U-shaped bracket.

DETAILED DESCRIPTION

In order to make the purpose, the technical solution and the advantages of the present application be clearer and more understandable, the present application will be further described in detail below with reference to accompanying figures and embodiments. It should be understood that the specific embodiments described herein are merely intended to illustrate but not to limit the present application.

In the description of the present application, it needs to be understood that, directions or location relationships indicated by terms such as "length", "width", "up", "down", "front", "rear", "left", "right", "vertical", "horizontal", "top", "bottom", "inside", "outside", and so on are the directions or location relationships shown in the accompanying figures, which are only intended to describe the present application conveniently and simplify the description, but not to indicate or imply that an indicated device or component must have specific locations or be constructed and manipulated according to specific locations; therefore, these terms shouldn't be considered as any limitation to the present application.

In addition, terms "the first" and "the second" are only used in describe purposes, and should not be considered as indicating or implying any relative importance, or impliedly indicating the number of indicated technical features. As such, technical feature(s) restricted by "the first" or "the second" can explicitly or impliedly comprise one or more such technical feature(s). In the description of the present application, "a plurality of" means two or more, unless there is additional explicit and specific limitation.

In the present application, unless there is additional explicit stipulation and limitation, terms such as "mount", "connect with each other", "connect", "fix", and so on should be generalizedly interpreted, for example, "connect" can be interpreted as being fixedly connected, detachably connected, or connected integrally; "connect" can also be interpreted as being mechanically connected or electrically connected; "connect" can be further interpreted as being directly connected or indirectly connected through intermediary, or being internal communication between two components or an interaction relationship between the two components. For the one of ordinary skill in the art, the specific meanings of the aforementioned terms in the present application can be interpreted according to specific conditions.

Figure 3:
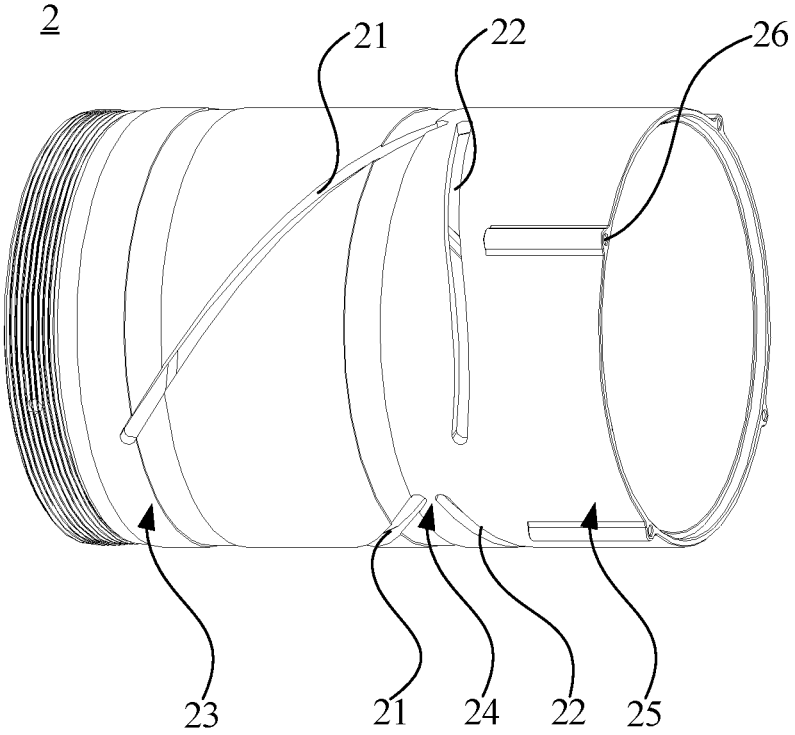
FIG. 3 is a structural view of a first housing of an optical lens provided by an embodiment of the present application.
Figure 4:
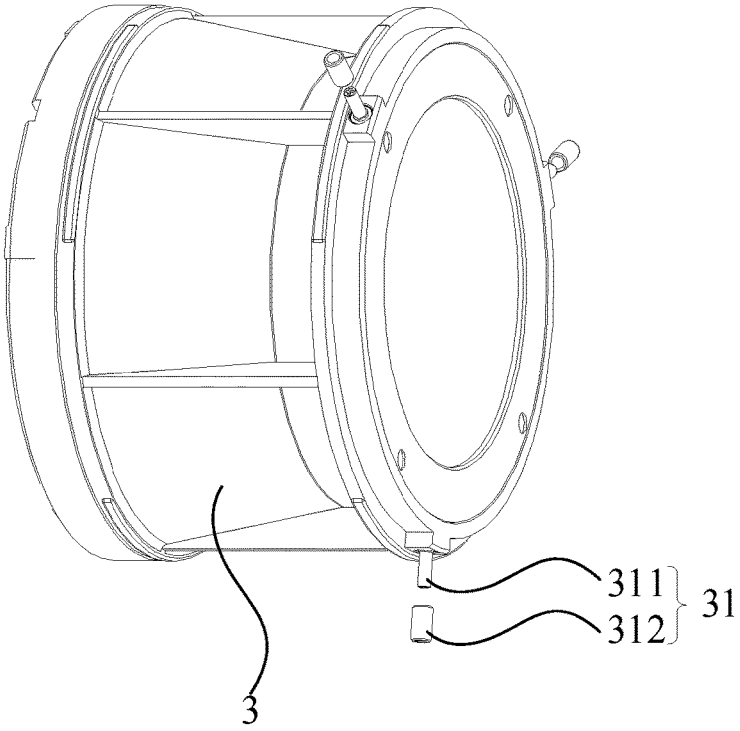
FIG. 4 is a structural view of a lens group of an optical lens provided by an embodiment of the present application.

Please refer to FIG. 1, FIG. 3, and FIG. 4. The present embodiment provides a lamp including a lamp body 1, a first housing 2 and a second housing 3. The first housing 2 is connected to the lamp body 1, and the outer wall of the first housing 2 is provided with a slot 21. The second housing 3 is movably sleeved inside the first housing 2, the outer wall of the second housing 3 is provided with a protruding member 31, and the protruding member 31 passes through the slot 21, and the protruding member 31 also moves relative to the second housing 3 when moving in the slot 21, to adjust the distance between the second housing 3 and the lamp body 1.

It should be noted that, the first housing 2 and the lamp body 1 can be connected directly, and can be connected indirectly, which can be set according to requirements. The number of the slots 21 arranged on the first housing 2 corresponds to the number of the protruding members 31 arranged on the second housing 3. The number of the protruding members 31 can be two, three, etc., and can be set according to requirements. The protruding members 31 can be evenly distributed on the outer peripheral wall of the second housing 3 or unevenly distributed on the outer peripheral wall of the second housing 3. The protruding member 31 moves relative to the second housing 3 at the same time when the protruding member 31 moves in the slot 21. It can be understood that when the protruding member 31 moves in the slot 2, a part of the protruding member 31 can also rotate or roll relative to the second housing 3 at the same time, and the other part thereof can be connected with the second housing 3 to drive the second housing 3 to move in the first housing 2.

In the lamp provided by the present embodiment, compared with the prior art lens components directly cooperate with the slot to generate sliding friction, when the protruding member 31 of the present embodiment moves in the slot 21 on the first housing 2, the protruding member 31 can also move relative to the second housing 3, such that rolling friction between the protruding member 31 and the second housing 3 is generated to reduce the friction of the protruding member 31 and reduce the wear on the components, so that the sliding of the second housing 3 in the first housing 2 is more smoothly. After each second housing 3 of the lamp is provided with a corresponding lens group, the focusing or other adjustment operations of the optical lens with the second housing 3 relative to the first housing 2 movement are smoother and more precise, which can improve the use experience and imaging quality of the lamp.

In another embodiment of the present application, please refer to FIGS. 3 and 4, the protruding member 31 includes a driving lever 311 and a driving lever ring 312, the driving lever 311 is fixedly connected to the outer wall of the second housing 3, and the driving lever ring 312 is movably sleeved on the driving lever 311. Of course, other forms of rotation, such as cylindrical or spherical, are also feasible.

It should be noted that, the driving lever ring 312 being movably sleeved on the driving lever 311 means that the driving lever ring 312 is sleeved on the driving lever 311 and can rotate relative to the driving lever 311.

In the lamp provided by this embodiment, when the second housing 3 moves in the first housing 2, the driving lever ring 312 is in contact with the wall surface of the slot 21, and the driving lever ring 312 and the inner wall of the slot 21 generate rolling friction, and the clearance fit of circumference smooth surface with a clearance being 0.05 mm, which can directly reduce the friction force when focus the driving lever, and such that the second housing 3 moves more accurately and smoothly in the first housing 2.

In another embodiment of the present application, the second housing 3 is provided therein with a lens group configured for receiving the light emitted from the lamp body 1, and the lens group is synchronously moved with the moving of the second housing 3.

It should be noted that, the number of lens groups can be one or more, and a single lens group can also include one or more lenses, the number and types of lenses can be set according to requirements, one or more lenses can be arranged along an optical axes of the lamp body 1 in sequence, and the light emitted by the lamp body 1 enters from one end of the first housing 2 and emits from the other end of the first housing 2 after being refracted by the first lens group.

In another embodiment of the present application, the second housing 3 is provided therein with a lens group, when the second housing 3 moves in the first housing 2, the distance between the lens group and the lamp body 1 changes, which can realize the focusing operation of the lamp, and the whole adjustment process is smooth and the adjustment accuracy is high.

Figure 2:
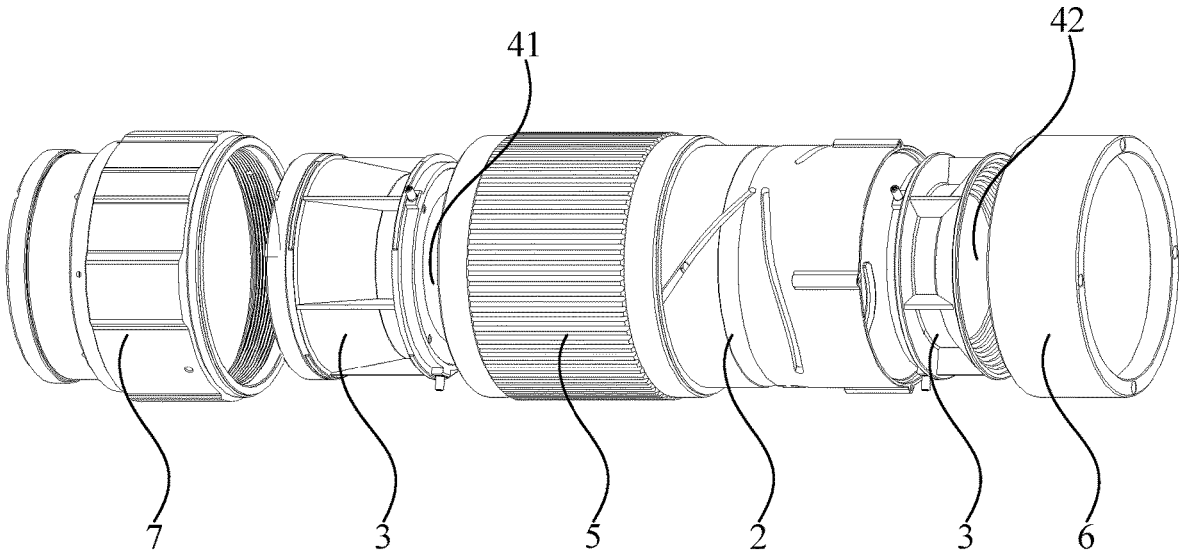
FIG. 2 is an explosion view of an optical lens provided by an embodiment of the present application.
Figure 5:
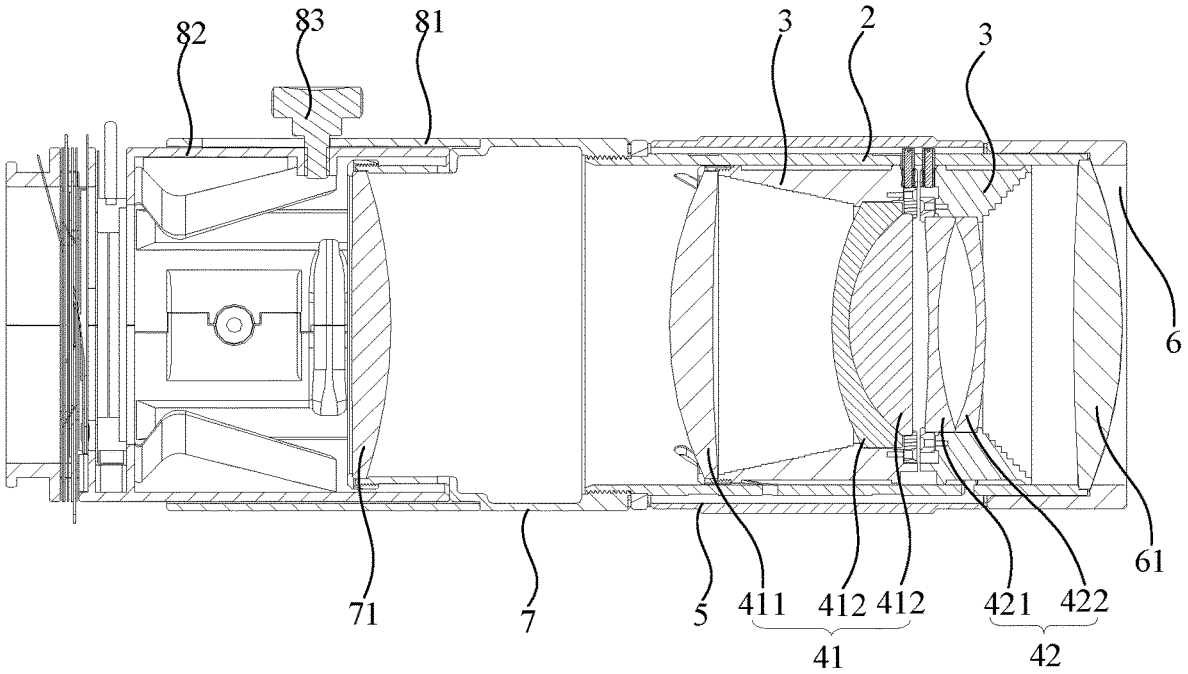
FIG. 5 is a cross-sectional view of an optical lens provided by an embodiment of the present application.

In another embodiment of the present application, please refer to FIG. 2 and FIG. 5, two second housings 3 are movably sleeved inside the first housing 2, and the second housing 3 close to the lamp body 1 is provided with a first lens group 41, and second housing 3 away from the lamp body 1 is provided with a second lens group 42, and the first lens group 41 and the second lens group 42 can be approached or moved away from each other.

Further, please refer to FIG. 3 together, the first housing 2 has a first end portion 23, a middle portion 24, and a second end portion 25 connected in sequence. The outer wall of the first housing 2 is provided with a set of slot 21 and a set of slot 22, and two sets of slots are spaced apart from each other, the protruding member 31 of the second housing 3 provided with the first lens group 41 passes through the lots 21 of the two sets of slots, and the set of slot 21 is extended from the middle portion 24 of the first housing 2 to the first end portion 23 of the first housing 2 along a axial direction of the first housing 2; the protruding member 31 of the second housing 3 provided with the second lens group 42 passes through the slot 22 of the two sets of slots, and the set of slot 22 is extended from the middle portion 24 of the first housing 2 first to the second end portion 25 of the first housing 2 and then to the first end portion 23, and the two sets of slots extend from the middle portion 24 of the first housing 2 in the circumferential direction of the first housing 2 to a same direction.

Figure 6:
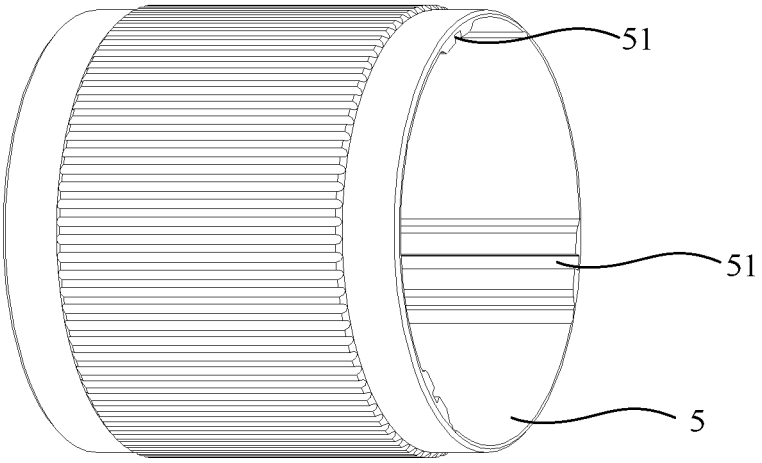
FIG. 6 is a structural view of an adjusting ring provided by an embodiment of the present application.
Figure 7:
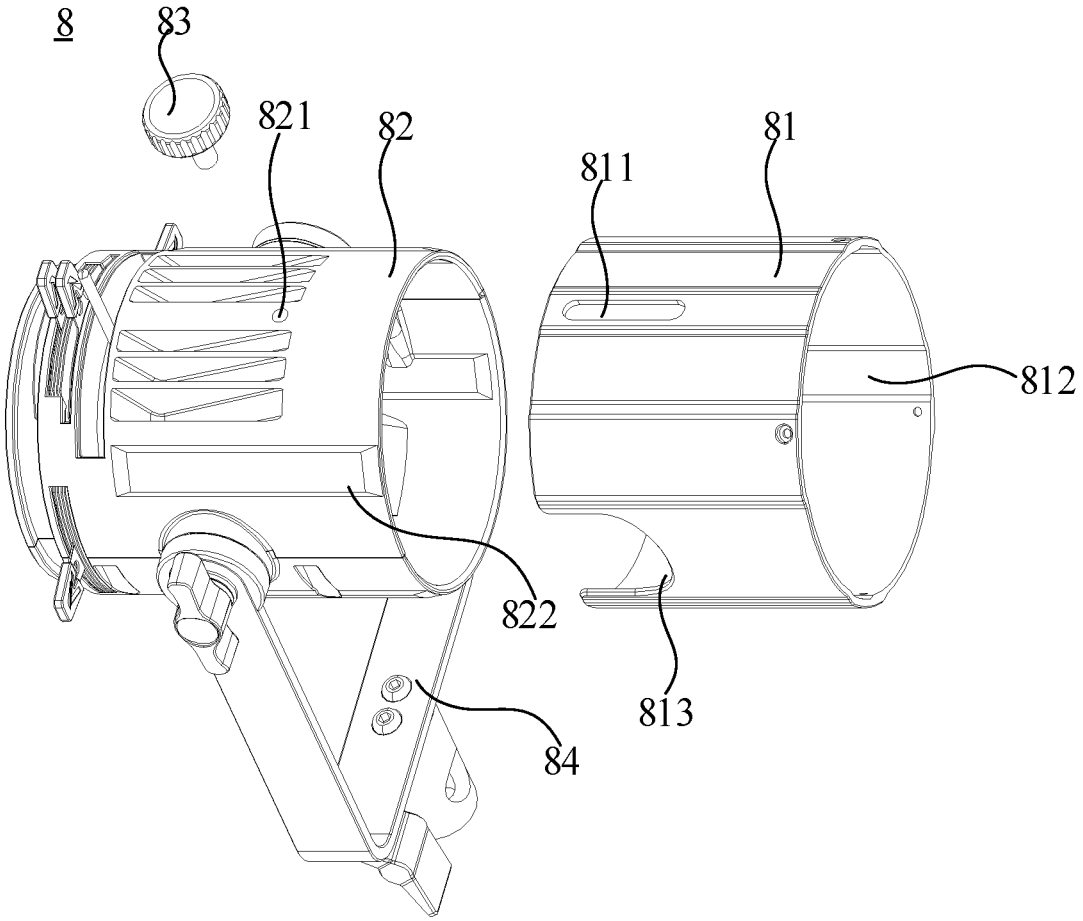
FIG. 7 is a structural view of a front-end light control cylinder assembly provided by an embodiment of the present application.

Further, please refer to FIG. 4 and FIG. 6 together, an adjusting ring 5 is sleeved outside of the first housing 2, and the inner wall of the adjusting ring 5 is formed with a plurality of notches 51 extending along the axial direction of the first housing 2 and corresponding to slots 21 and 22 respectively. The outer end of the protruding member 31 of the second housing 3 extends to the corresponding notch 51 through the corresponding slot. The outer wall of the adjusting ring 5 is provided with friction stripes, which can facilitate the user to manually rotate the adjusting ring. Among then, the adjusting ring 5 is configured to rotate along the circumference of the first housing 2 to drive the protruding member 31 to move along the inner wall of the slot 21 and/or the inner wall of the notch 51. It can be understood that the protruding member 31 can contact the inner wall of slot 21 and the inner wall of notch 51 at the same time and roll with the inner wall of slot 21 and the inner wall of notch 51. Of course, it can also be in contact with one of the above inner walls, for example, it can be that the protruding member 31 is mainly in contact with the inner wall of notch 51 but not with the inner wall of slot 21, or the protruding member 31 is mainly in contact with the inner wall of slot 21 but not with the inner wall of notch 51. More specifically, it can be understood that when the adjusting ring 5 is rotated, the driving lever ring 312 rotates relative to the driving lever 311, and the driving lever ring 312 can contact both the inner wall of the notch 51 and the inner wall of the slot 21 to form rolling friction. Of course, the driving lever ring 312 may only contact the inner wall of the notch 51 to form rolling friction, or only the inner wall of the slot 21 may contact to form rolling friction. It should be noted that, the number and positions of the protruding members 31 on each second housing 3 can be set according to requirements, and the number of protruding members 31 on the two second housing 3 can be the same or different. The first housing 2 is provided with a set of slot 21 and a set of slot 22; the number and position of the slot 21 correspond to the number and position of the protruding member 31 on the second housing 3 with the first lens group 41, and the number and position of the slot 22 correspond to the number and position of the protruding member 31 on the second housing 3 with the second lens group 42. It can be set according to requirements, and the slot 21 and the slot 22 provided on the first housing 2 are arranged at intervals to avoid collisions during the movement of the housing.

Each slot has a corresponding notch 51 on the inner wall of the first housing 2. The notch 51 corresponding to slot 21 and the notch 51 corresponding to slot 22 can be on the same straight line (that is, overlap), and the straight line is parallel to the axis of the first housing 2. Of course, the notch 51 corresponding to slot 21 and notch 51 corresponding to slot 22 can also be set separately. It can be understood that the notch 51 corresponding to slot 21 and notch 51 corresponding to slot 22 are parallel to each other, and the two do not overlap.

In the lamp provided in the present embodiment, the top end of the protruding member 31 on the second housing 3 with the first lens group 41 passes through the corresponding slot 21 and then extends to the corresponding notch 51, and the top end of the protruding member 31 on the second housing 3 with the second lens group 42 passes through the corresponding slot 22 and then extends to the corresponding notch 51, since the slot 21 extends from the middle portion 24 of the first housing 2 to the first end portion 23 of the first housing 2 in the axial direction of the first housing 2; the slot 22 extends from the middle portion 24 of the first housing 2 first to the second end portion 25 of the first housing 2 and then to the first end portion 23 in the axial direction of the first housing 2, and the slots 21 and 22 are extended from middle portion 24 of the first housing 2 to a same direction in the circumferential direction of the first housing 2. When the adjusting ring 5 is rotated, the first lens group 41 can move along the axis of the first housing 2 and rotate in the first housing 2 through the cooperation of the notch 51 with the corresponding protruding member 31; the second lens group 42 can also move along the axis of the first housing 2 and rotate in the first housing 2. Therefore, when the adjusting ring 5 is rotated, the first lens group 41 and the second lens group 44 can be approached and moved away from each other, which can realize the focusing operation of the lamp. In addition, the arc-shaped slot 22 first extends toward the second end portion 25 and then extends toward the opposite first end portion 23 in the direction relative to the optical axis, so one of the lens groups (the second lens group 42) can first move toward the second end portion 25 then move toward the first end portion 23, so that the length of the first housing 2 can be reduced while to satisfy the optical conditions. Compared with adjusting a single lens group, the lamp provided in the present embodiment not only has the advantages of precise and smooth focusing operation and higher adjustment accuracy, but also larger focusing stroke can be obtained by rotating the adjusting ring 5 at a smaller angle, the focusing range is increased, the lighting shape is enriched, and the focusing operation is more flexible.

In another embodiment of the present application, referring to FIG. 5, the first lens group 41 is sequentially provided with a first convex lens 411, a first concave lens 412, and a second convex lens 413 in the light propagation direction; the second lens group 42 is sequentially provided with a second concave lens 421 and a third concave lens 422 in the light propagation direction.

In another embodiment of the present application, please refer to FIG. 3, the slots include three arc-shaped slots arranged at intervals in the circumferential direction, that is, the outer wall of the first housing 2 is circumferentially provided with three arc-shaped slots 21 and three arc-shaped slots 22.

It should be noted that, the number of slots 21 matches the number of protruding members 31 on the second housing 3 with the first lens group 41, and the number of slots 22 matches the number of protruding members 31 on the second housing 3 with the second lens group 42, which can be set according to the requirements. In the embodiment, the outer walls of the two second housings 3 are each provided with three protruding members 31, and the three protruding members 31 of the second housing 3 with the first lens group 41 are respectively fitted onto the three arc-shaped slots 21 having positions corresponding to the first lens group 41, and the three protruding members 31 of the second housing 3 with the second lens group 42 are respectively fitted onto the three arc-shaped slots 21 having positions corresponding to the second lens group 42. The three arc-shaped slots 21 are evenly distributed on the wall of the first housing 2, and the three arc-shaped slots 22 are also evenly distributed on the wall of the first housing 2, to limit the second housing 3 to the first housing 2 from three angles. It can effectively reduce the shaking of the first lens group 41 and the first lens group 42 in the first housing 2, and the movement is more stable, the imaging quality of the lamp is ensured.

In another embodiment of the present application, please refer to FIG. 5, the lamp further includes a cap 6 and a fourth convex lens 61. The cap 6 is disposed at an end of the first housing 2 away from the lamp body 1, and the fourth convex lens 61 is fixedly disposed between the cap 6 and the first housing 2.

Furthermore, the first housing 2 is provided with a predetermined number of first positioning holes 26 on the side close to the cap 6, and the cap 6 is provided with second positioning holes corresponding to the first positioning holes 26 on the side close to the first housing 2. Each of the first positioning holes 26 and the corresponding second positioning hole are both penetrated by a fixing member, and the fixing member may be a screw, a pin, etc., for fixing the cap 6 and the first housing 2. It can be understood that the positioning pin can be penetrated on the first housing 2 from the end of the pressing ring, which can reduce the exposure of the fixing member.

The first housing 2 and the cap 6 can also be fixedly connected by snap-in connection, threaded connection, etc. In the embodiment, the first housing 2 and the cap 6 are fixed by the interference fit of the fixing member and the positioning hole, and the first housing 2 is provided with a predetermined number of first positioning holes 26 on the side close to the cap 6, the depth direction of the first positioning holes 26 is parallel to the axial direction of the first housing 2, and the cap 6 is provided with second positioning holes (not shown) having the same number as the first positioning holes 26 on the side close to the first housing 2, the first positioning hole 26 and the second positioning hole cooperate with each other, and each first positioning hole 26 and its corresponding second positioning hole are penetrated by a positioning pin for fixing the cap 6 and the first housing 2.

In another embodiment of the present application, please refer to FIG. 5, the lamp further includes an adapter cylinder 7 and a third convex lens 71. The adapter cylinder 7 is fixedly arranged at one end of the first housing 2 close to the lamp body 1, and the third convex lens 71 is fixedly arranged at one end of the first housing 2 away from the lamp body 1.

It should be noted that, the adapter cylinder 7 and the first housing 2 can be fixedly connected by screw connection, snap-in connection or other connection methods. In the embodiment, the adapter cylinder 7 and the first housing 2 are connected by screw threads.

In another embodiment of the present application, please refer to FIGS. 6 and 8. The lamp further includes a front-end light control cylinder assembly 8. The two ends of the front-end light control cylinder assembly 8 are respectively connected to the adapter cylinder 7 and the lamp body 1, and the front-end light control cylinder assembly 8 can expand and contract along the axial direction of the optical axis to adjust the distance between the adapter cylinder 7, the second housing 3 and the first housing 2 as a whole and the lamp body 1.

Further, the radius of adapter cylinder 7 gradually decreases from adapter cylinder 7 to lamp body 1, the front-end light control cylinder assembly 8 includes a telescopic cylinder 81, a support cylinder 82, and a focusing knob 83; the telescopic cylinder 81 is fixed to the adapter cylinder 7. The telescopic cylinder 81 is provided with a guiding groove 811 and a positioning groove 812 extending along the axial direction of the telescopic cylinder 81; one end of the support cylinder 82 is extended in and located between the adapter cylinder 7 and the telescopic cylinder 81, and the other end thereof can be provided with one or more of an optical sectioning sheet, a diaphragm and a pattern sheet, and the support cylinder 82 is fixedly connected with a U-shaped bracket 84 at an outer wall thereof and provided with a focus positioning hole 821 corresponding to a position of the guiding groove 811, the outer wall of the support cylinder 82 further provided with a positioning protrusion 822 corresponding to a position of the positioning groove 812; the focusing knob 83 passes through the guiding groove 811 and is matched with the focus positioning hole 821.

It should be noted that, the radius of the adapter cylinder 7 gradually decreases in the direction from the adapter cylinder 7 to the lamp body 1. In the embodiment, the adapter cylinder 7 is a stepped cylinder with three steps, which can make each joint not excessively protruding. It can be understood that the outer surface between the front-end light control cylinder assembly 8, the adapter cylinder 7 and the adjusting ring 5 is substantially flush in the direction of the optical axis.

One end of the front-end light control cylinder assembly 8 is connected to lamp body 1, and the other end is connected to adapter cylinder 7. One end of the telescopic cylinder 81 is fixedly connected with the step in the middle of the adapter cylinder 7. The guiding groove 811 formed on the wall of the telescopic cylinder 81 extends along the axial direction of the telescopic cylinder 81, and the opposite sides of an end of the telescopic cylinder 81 are respectively provided with a U-shaped groove, and the opening direction of the U-shaped groove 813 is the same as the axial direction of the telescopic cylinder 81 and faces the support cylinder 82, and the length direction of the positioning groove 813 arranged on the inner wall of the telescopic cylinder 81 is parallel to the axial direction of the telescopic cylinder 81.

The end of the support cylinder 82 away from the light source extends between the adapter cylinder 7 and the telescopic cylinder 81, that is, the inner wall of the support cylinder 82 is in contact with the step surface of the smallest radius of the adapter cylinder 7, and the outer wall of the support cylinder 82 is in contact with the inner side of the telescopic cylinder 81. The support cylinder 82 is provided with a focus positioning hole 821 configured to be fit to the guiding groove 811 on the cylinder wall. The two opposite sides of the outer wall of the support cylinder 82 are respectively fixedly connected to the two ends of the U-shaped bracket 24, and the connecting portion of the U-shaped bracket 24 and the support cylinder 82 is respectively sleeved in one of the U-shaped grooves 813 of the telescopic cylinder 81. The telescopic cylinder 81 is supported by the U-shaped bracket 24 and can still move along the axial direction of the telescopic cylinder 81. The outer wall of the support cylinder 82 is also provided with the positioning protrusions 812 along the axial direction of the telescopic cylinder. The positioning protrusions 812 cooperate with the positioning grooves 813 to restrict the telescopic cylinder 81 from rotating relative to the support cylinder 82 around the central axis of the telescopic cylinder 81, but not to restrict the telescopic cylinder 81 from moving relative to the support cylinder 82 along its axial direction. The focusing knob 83 passes through the guiding groove 811 and then cooperates with the focus positioning hole 821.

After adjusting the focal length in the manner in the foregoing embodiment, the structure in the present embodiment can be used for manual focusing. During the focusing operation, loosen the focusing knob 83, move the telescopic cylinder 81 to focus, tighten the focusing knob 83, the telescopic cylinder 81 and the support cylinder 82 are relatively fixed, and the adapter cylinder 7 fixedly connected to the telescopic cylinder 81 is fixed. When you need to refocus later, release the focusing knob 83 and repeat the above operation. The end of the front-end light control cylinder assembly 8 away from the cap is provided with one or more of an optical sectioning sheet, a diaphragm and a pattern sheet to limit the light beam or limit the size of the field of view and the patterned light produced, which enriches the lighting model.

The embodiment of the present application also provides an optical lens for adjusting the imaging of the lamp body 1. Please refer to FIG. 3 to FIG. 5. The optical lens provided by this embodiment includes: a first housing 2, a second housing 3, and lens groups 41, 42; the first housing 2 is connected to the lamp body, and the outer wall of the first housing is provided with a slot 21; the second housing 3 is movably sleeved inside the first housing 2; and the outer wall of the second housing is provided with a protruding member 31, the protruding member passes through the slot 21, the protruding member 31 further simultaneously moves relative to the second housing 3 while moves in the slot 21, to adjust a distance between the second housing 3 and the lamp body 1; and the lens groups 41, 42 are fixedly arranged in the second housing 3, and light emitted by the lamp body 1 enters from one end of the first housing 2 and is refracted by the lens groups 41, 42 to be passed out from the other end of the first housing 2, and the lens groups 41, 42 are synchronously moved with moving of the second housing 3.

In the optical lens provided by the present embodiment, the second housing 3 drives the lens groups 41 and 42 to move relative to the second housing 3 in the axial direction of the first housing 2 to achieve focusing of the optical lens. Moreover, since the protruding member 31 provided on the second housing 3 moves relative to the second housing 3 while moves in the slot 21 of the first housing 2, sliding friction can be achieved between the protruding member 31 and the slot 21, which can reduce the friction resistance of the protruding member 31, such that the focusing operation is precise and smooth, and the focusing adjustment accuracy is high.

The present application further provides an optical lens for adjusting an imaging of a lamp body 1. Please refer to FIG. 3 to FIG. 6. The optical lens provided by this embodiment includes: a first housing 2, two second housings, and a first lens group 41, a second lens group 42 and a focusing ring 5. The first housing 2 is connected to the lamp body 1, and the outer wall of the first housing 2 is provided with two sets of slots 21, 22; the two second housings 3 are movably sleeved inside the first housing 2; the outer wall of the second housing 3 is provided with a protruding member 31, the protruding member 31 of one of the two second housings 3 passes through the slot 21 of the two sets of slots, and the other protruding member 31 of one of the two second housings 3 passes through the slot 22 of the two sets of slots, and the protruding members 31 further moves relative to the second housing 3 while moves in the corresponding slots; the first lens group 41 is arranged in the second housing 3 close to the lamp body 1; the second lens group 42 is arranged in a second housing 3 away from the lamp body 1, light emitted by the lamp body 1 enters from one end of the first housing 2 and is refracted by the first lens group 41 and the second lens group 42 in sequence to be passed out from the other end of the first housing 2, and the adjusting ring 5 is rotatably sleeved on the outer wall of the first housing 2 relative to the first housing 2, and the adjusting ring 5 is provided therein with a plurality of notches 51 configured for matching with the two sets of slots 21, 22, and the protruding members 31 of the second housing 3 pass through the corresponding slots 21, 22 and extend to the corresponding notches 51, to drive the first lens group 41 and the second lens group 42 to approach or move away from each other.

The optical lens provided in the present embodiment drives the first lens group 41 and the second lens group 42 to move relative to the first housing 2 in the axial direction of the first housing 2 through the second housing 3. The first lens group 41 and the second lens group 42 can be approached or moved away from each other to achieve the focusing operation of the optical lens. Moreover, since the protruding member 31 provided on the second housing 3 moves relative to the second housing 3 while moves in the slot 21 of the first housing 2, sliding friction can be achieved between the protruding member 31 and the slot 21, which can reduce the friction resistance of the protruding member 31, such that the focusing operation is precise and smooth, and the focusing adjustment accuracy is high, and the adjusting ring 5 can be rotated by a small angle to obtain a larger focusing stroke, which increases the focusing range and enriches the light modeling and the focusing operation is more flexible.

The aforementioned embodiments are only preferred embodiments of the present application, and should not be regarded as being limitation to the present application. Any modification, equivalent replacement, improvement, and so on, which are made within the spirit and the principle of the present application, should be included in the protection scope of the present application.

What is claimed is:

1. A lamp, comprising a lamp body, wherein the lamp further comprises:

a first housing, connected to the lamp body, and an outer wall of the first housing is provided with slots; and two second housings, movably sleeved inside the first housing; an outer wall of each of the second housings is provided with a protruding member extending through the slots;

wherein the protruding member further simultaneously moves relative to the second housings while moves in the slot, to adjust a distance between the second housings and the lamp body;

wherein the first housing is sleeved with an adjusting ring, and an inner wall of the adjusting ring is provided with a plurality of notches extending along an axial direction of the first housing and respectively corresponding to the slots; a distal end of the protruding member of the second housings passes through the corresponding slots and extends into the corresponding notch, and the adjusting ring is configured to rotate along a circumferential direction of the first housing to drive the protruding member to move along an inner wall of the slot and/or an inner wall of the notch;

wherein the first housing is movably sleeved with the two second housings, the second housing close to the lamp body is provided with a first lens group, and the second housing away from the lamp body is provided with a second lens group, and the first lens group and the second lens group can be approached or moved away from each other;

wherein the lamp further comprises an adapter cylinder and a third convex lens, the adapter cylinder is fixedly arranged at an end of the first housing close to the lamp body, the third convex lens is fixedly arranged at an end of the adapter cylinder away from the first housing; and wherein the lamp further comprises a front-end light control cylinder assembly, two ends of the front-end light control cylinder assembly are respectively connected to the adapter cylinder and the lamp body, and the front-end light control cylinder assembly is able to extend and contract along an axial direction of an optical axis to adjust a distance between the adapter cylinder, the second housing and the first housing that are as a whole and the lamp body.

2. The lamp of claim 1, wherein the protruding member comprises a driving lever and a driving lever ring, the driving lever is fixedly connected to the outer wall of the second housings, and the driving lever ring is movably sleeved onto the driving lever.

3. The lamp of claim 1, wherein the second housings are provided therein with the first and second lens groups respectively configured for receiving light emitted from the lamp body, and the first and second lens groups are synchronously moved as moving of the second housings.

4. The lamp of claim 1, wherein the first housing is provided with a first end portion, a middle portion and a second end portion connected in sequence, and the outer wall of the first housing is provided with the two sets of the slots spaced apart from each other; the protruding member of the second housing provided with the first lens group passes through the slot of the two sets of the slots, and the slot extends from the middle portion of the first housing to the first end portion of the first housing along an axial direction of the first housing; the protruding member of the second housing provided with the second lens group passes through the slot of the two sets of the slots, and the slot extends from the middle portion of the first housing to the second end portion of the first housing firstly and then to the first end portion of the first housing along an axial direction of the first housing, and the two set of the slots are extended from the middle portion of the first housing to a same direction along a circumferential direction of the first housing.

5. The lamp of claim 1, wherein the first lens group is sequentially provided with a first convex lens, a first concave lens and a second convex lens in a light propagation direction; the second lens group is sequentially provided with a second concave lens and a third concave lens in a light propagation direction.

6. The lamp of claim 1, wherein the slots comprises three arc-shaped slots arranged at intervals in a circumferential direction.

7. The lamp of claim 1, wherein the lamp further comprises a cap and a fourth convex lens, the cap is arranged on an end of the first housing away from the lamp body, and the fourth convex lens is fixedly arranged between the cap and the first housing.

8. The lamp of claim 7, wherein the first housing is provided with a predetermined number of first positioning holes on a side close to the cap, and the cap is provided with second positioning holes corresponding to the first positioning holes on a side close to the first housing, each first positioning hole and its corresponding second positioning hole are penetrated by a fixing member for fixedly connecting the cap and the first housing.

9. The lamp of claim 1, wherein radius of the adapter cylinder gradually decreases from a direction of the adapter cylinder to the lamp body, the front-end light control cylinder assembly comprises a telescopic cylinder, a support cylinder and a focusing knob; the telescopic cylinder is fixedly connected to the adapter cylinder, and a wall of the telescopic cylinder is provided with a guiding groove and a positioning groove extended along an axial direction of the telescopic cylinder; one end of the support cylinder extends into the telescopic cylinder and located between the adapter cylinder and the telescopic cylinder, the other end thereof can be provided with one or more of an optical sectioning sheet, a diaphragm and a pattern sheet, and the support cylinder is fixedly connected with a U-shaped bracket at an outer wall thereof and provided with a focus positioning hole corresponding to a position of the guiding groove and a positioning protrusion corresponding to a position of the positioning groove; the focusing knob passes through the guiding groove and is matched with the focus positioning hole.

10. An optical lens for adjusting an imaging of a lamp body, comprising:

a first housing, connected to the lamp body, and an outer wall of the first housing being provided with two sets of slots;

two second housings, movably sleeved inside the first housing; wherein an outer wall of each of the second housings is provided with a protruding member, the protruding member of one of the two second housings passes through the slot of the two sets of slots, and the other protruding member of one of the two second housings passes through the slot of the two sets of slots, wherein the protruding members further simultaneously moves relative to the second housing while moves in the corresponding slots;

a first lens group, arranged in the second housing close to the lamp body;

a second lens group, arranged in the second housing away from the lamp body, light emitted by the lamp body enters from one end of the first housing and is refracted by the first lens group and the second lens group in sequence to be passed out from the other end of the first housing, and an adjusting ring, rotatably sleeved on an outer wall of the first housing relative to the first housing, and the adjusting ring is provided therein with a plurality of notches configured for matching with the two sets of slots, and the protruding members of the second housing pass through the corresponding slots and extend to the corresponding notches, to drive the first lens group and the second lens group to approach or move away from each other;

wherein the lamp further comprises an adapter cylinder and a third convex lens, the adapter cylinder is fixedly arranged at an end of the first housing close to the lamp body, the third convex lens is fixedly arranged at an end of the adapter cylinder away from the first housing; and wherein the lamp further comprises a front-end light control cylinder assembly, two ends of the front-end light control cylinder assembly are respectively connected to the adapter cylinder and the lamp body, and the front-end light control cylinder assembly is able to extend and contract along an axial direction of an optical axis to adjust a distance between the adapter cylinder, the second housing and the first housing that are as a whole and the lamp body.

11. A lamp, comprising a lamp body, wherein the lamp further comprises:

a first housing, connected to the lamp body, and an outer wall of the first housing is provided with slots; and a second housing, movably sleeved inside the first housing; an outer wall of the second housing is provided with a protruding member extending through the slots;

wherein the protruding member further simultaneously moves relative to the second housing while moves in the slot, to adjust a distance between the second housing and the lamp body;

wherein the first housing is movably sleeved with two second housings, the second housing close to the lamp body is provided with a first lens group, and the second housing away from the lamp body is provided with a second lens group, and the first lens group and the second lens group can be approached or moved away from each other;

wherein the lamp further comprises an adapter cylinder and a third convex lens, the adapter cylinder is fixedly arranged at an end of the first housing close to the lamp body, the third convex lens is fixedly arranged at an end of the adapter cylinder away from the first housing; and wherein the lamp further comprises a front-end light control cylinder assembly, two ends of the front-end light control cylinder assembly are respectively connected to the adapter cylinder and the lamp body, and the front-end light control cylinder assembly is able to extend and contract along an axial direction of an optical axis to adjust a distance between the adapter cylinder, the second housing and the first housing that are as a whole and the lamp body.

12. The lamp of claim 11, wherein radius of the adapter cylinder gradually decreases from a direction of the adapter cylinder to the lamp body, the front-end light control cylinder assembly comprises a telescopic cylinder, a support cylinder and a focusing knob; the telescopic cylinder is fixedly connected to the adapter cylinder, and a wall of the telescopic cylinder is provided with a guiding groove and a positioning groove extended along an axial direction of the telescopic cylinder; one end of the support cylinder extends into the telescopic cylinder and located between the adapter cylinder and the telescopic cylinder, the other end thereof can be provided with one or more of an optical sectioning sheet, a diaphragm and a pattern sheet, and the support cylinder is fixedly connected with a U-shaped bracket at an outer wall thereof and provided with a focus positioning hole corresponding to a position of the guiding groove and a positioning protrusion corresponding to a position of the positioning groove; the focusing knob passes through the guiding groove and is matched with the focus positioning hole.

* * * * *